US007353745B2

(12) United States Patent
Fiebing et al.

(10) Patent No.: US 7,353,745 B2
(45) Date of Patent: Apr. 8, 2008

(54) HYDROSTATIC ADJUSTMENT UNIT WITH SWASHPLATE, ROTATING CYLINDER BLOCK AND A ROTATIONAL SPEED SIGNAL TRANSMITTER

(75) Inventors: Carsten Fiebing, Jevenstedt (DE); Bernd Hames, Henstedt-Ulzburg (DE)

(73) Assignee: Sauer-Danfoss Inc., Ames, IA (US)

( * ) Notice: Subject to any disclaimer, the term of this patent is extended or adjusted under 35 U.S.C. 154(b) by 461 days.

(21) Appl. No.: 11/035,529

(22) Filed: Jan. 14, 2005

(65) Prior Publication Data

US 2005/0196289 A1 Sep. 8, 2005

(30) Foreign Application Priority Data

Mar. 3, 2004 (DE) ..... 10 2004 010 351

(51) Int. Cl.
*F01B 3/00* (2006.01)

(52) U.S. Cl. ..... 91/499

(58) Field of Classification Search ..... 417/269, 417/222.1, 222.2, 437, 902; 91/499
See application file for complete search history.

(56) References Cited

U.S. PATENT DOCUMENTS 3,933,082 A * 1/1976 Molly ..... 91/485
4,893,548 A * 1/1990 Kawahara et al. ..... 91/499
5,059,097 A * 10/1991 Okazaki et al. ..... 417/222.2

* cited by examiner

*Primary Examiner*—Michael Koczo, Jr.

(57) ABSTRACT

A hydrostatic adjustment unit with a swash plate for adjusting the stroke of displacer pistons which are arranged in a rotating cylinder block is described. The displacer pistons each have a slider block which bears against a support face of the swash plate and is held in abutment by means of a slider block holder. The slider block-holder has a number of bores for receiving the slider blocks corresponding to the number of displacers. The slider block holder at the same time forms the rotor of a rotational speed signal transmitter for determining the rotational speed of the cylinder block.

6 Claims, 3 Drawing Sheets

HYDROSTATIC ADJUSTMENT UNIT WITH SWASHPLATE, ROTATING CYLINDER BLOCK AND A ROTATIONAL SPEED SIGNAL TRANSMITTER

BACKGROUND OF THE INVENTION

The invention relates to a hydrostatic adjustment unit with a swash plate for adjusting the stroke of displacer pistons which are arranged in a rotating cylinder block, and with a rotational speed signal transmitter for determining the rotational speed of the cylinder block.

In hydrostatic adjustment units with a swash plate design, which may be embodied as a pump or a motor, displacer pistons are provided which are guided in cylinders and which rotate about the shaft of the adjustment unit. During the rotation, the displacer pistons are supported on the swash plate and carry out one complete stroke during a 360° rotation. The swash plate forms in this case a planar support face against which the displacer pistons abut by means of a slider block. The slider blocks are held in abutment against the swash plate by a slider block holder which has a number of bores for receiving the slider blocks corresponding to the number of displacers.

In order to measure the rotational speed of the pump or motor, a rotational speed signal transmitter is provided. In this respect it is known from commercial practice for one or more magnets, which have an associated sensor permanently arranged in the housing, to be provided on the cylinder. Another possibility is to use a toothed ring which is shrink-fitted onto the cylinder and which forms the rotor of an inductive rotational speed signal transmitter. All of the solutions known from commercial practice require however the installation of additional parts, making assembly more difficult and entailing additional costs.

The invention therefore provides a hydrostatic adjustment unit which is improved in terms of manufacture and assembly.

This is achieved with a hydrostatic adjustment unit according to claim 1. Expedient developments are defined in the dependent claims.

SUMMARY OF INVENTION

The invention provides a hydrostatic adjustment unit with a swash plate for adjusting the stroke of displacer pistons which are arranged in a rotating cylinder block, and a rotational speed signal transmitter for determining the rotational speed of the cylinder block. The displacer pistons each have a slider block which bears against a support face of the swash plate and is held in abutment against the swash plate by means of a slider block holder. The slider block holder has a number of bores for receiving the slider blocks corresponding to the number of displacers, and at the same time forms the rotor of the rotational speed signal transmitter.

A fixed sensor part of the rotational speed signal transmitter is preferably arranged opposite the slider block holder in the wall of the housing which surrounds the cylinder.

In one development of the invention, the slider block holder is embodied as a gearwheel whose teeth preferably have a rectangular profile, triangular profile or a trapezoidal profile in order to produce an optimum rotational speed signal. It is particularly advantageous if the edges of the teeth of the slider block holder are of asymmetrical design and if an evaluation device is provided which determines the sense of rotation of the cylinder block on the basis of the asymmetry of the tooth edges. The rotational speed signal transmitter here is preferably inductive.

DESCRIPTION OF DRAWINGS

Further advantages, features and possible applications of the invention emerge from the following description of exemplary embodiments which are explained in more detail with reference to the figures, in which.

DETAILED DESCRIPTION OF INVENTION

Figure 1:
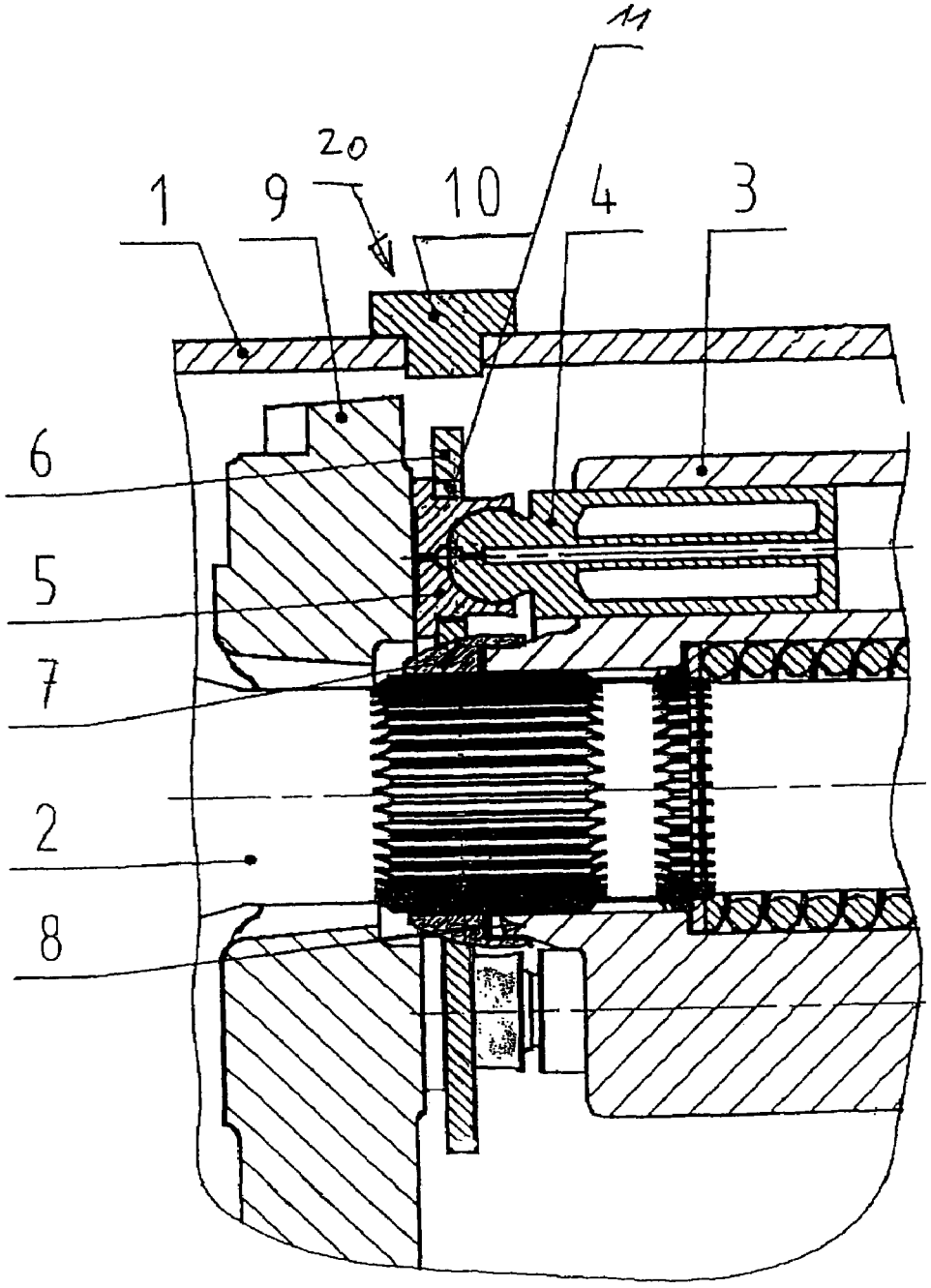
FIG. 1 shows a section through the central part of the hydrostatic adjustment unit according to the invention.

A cylinder block 8 with a plurality of cylinders 3, in each of which a displacer piston 4 is movably guided, rotates with the shaft 2. Each displacer piston 4 is connected in an articulated fashion to a slider block 5 with which it is supported on a support face of the swash plate 9. The swash plate 9 can pivot in a known fashion by means of a servosystem in order to adjust the stroke of the displacer pistons 4, i.e. in order to change the volume flow.

The slider blocks 5 of the displacer pistons 4 are held in abutment against the awash plate 9 by means of a slider block holder 6. The slider block holder 6 is provided for this purpose with a number of bores 11 corresponding to the number of displacer pistons 4 in order to receive the slider blocks 5, and is supported on the shaft 2 by means of a guide face 7. The slider block holder 6 is at the same time embodied as a rotor of a rotational speed signal transmitter whose sensor 10 is mounted in a wall part associated with the housing 1, opposite the slider block holder 6.

As is shown by FIGS. 2*a* to 2*d*, the slider block holder 6 is preferably embodied as a gearwheel which forms the rotor of an inductive rotational speed signal transmitter. In order to obtain a rotational speed signal which can be evaluated in an optimum way, the teeth 12 of the gearwheel preferably have a rectangular profile. In another embodiment, the tooth edges are embodied as triangles 13 or with a trapezoidal profile 14.

Figure 2:
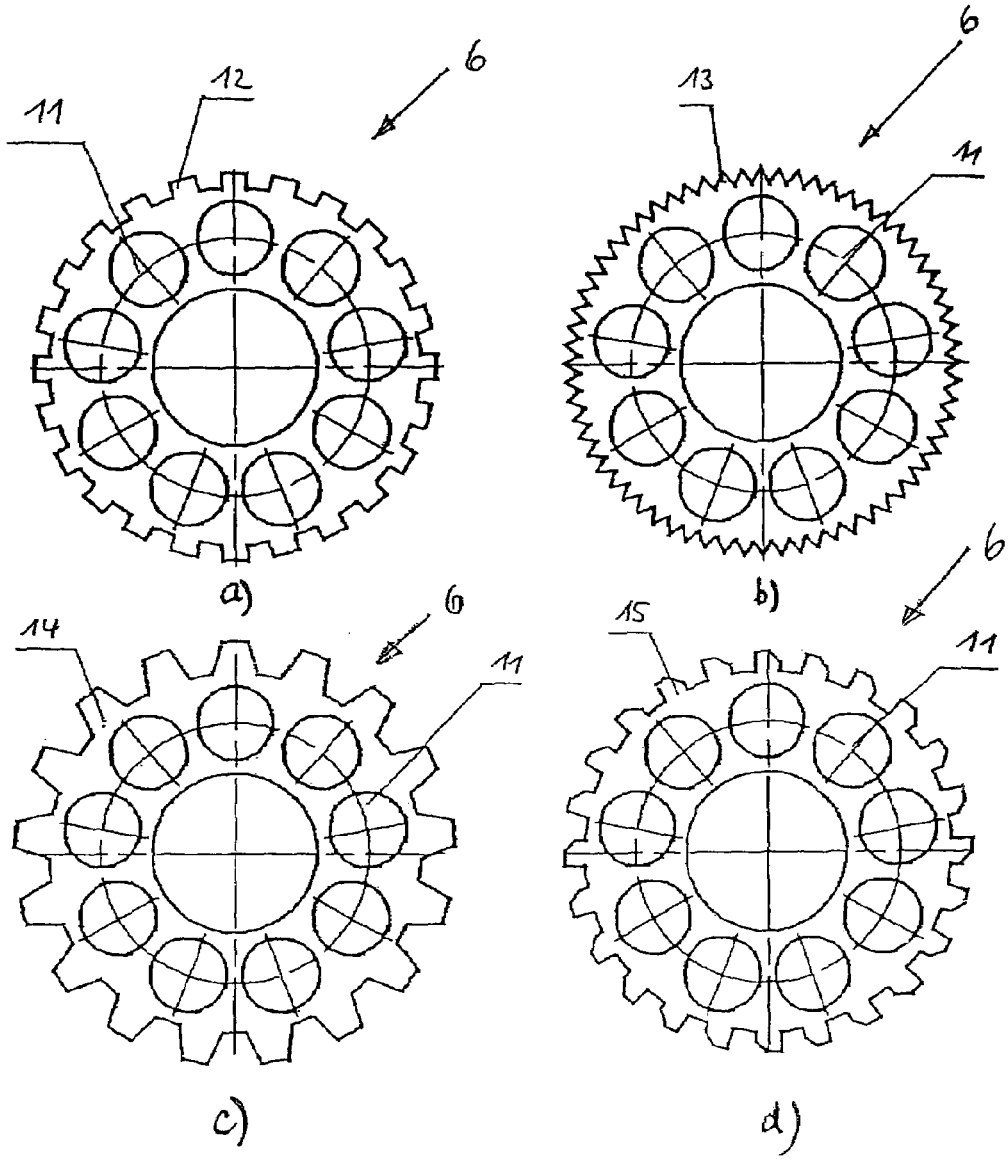
FIGS. 2*a* to 2*d* show various embodiments of the slider block holder.

FIG. 2*d* shows a particularly advantageous refinement with asymmetrical tooth edges 15. As a result, both the rotational speed and the sense of direction of the cylinder block 8 can be determined using a suitable evaluation device.

Figure 3:
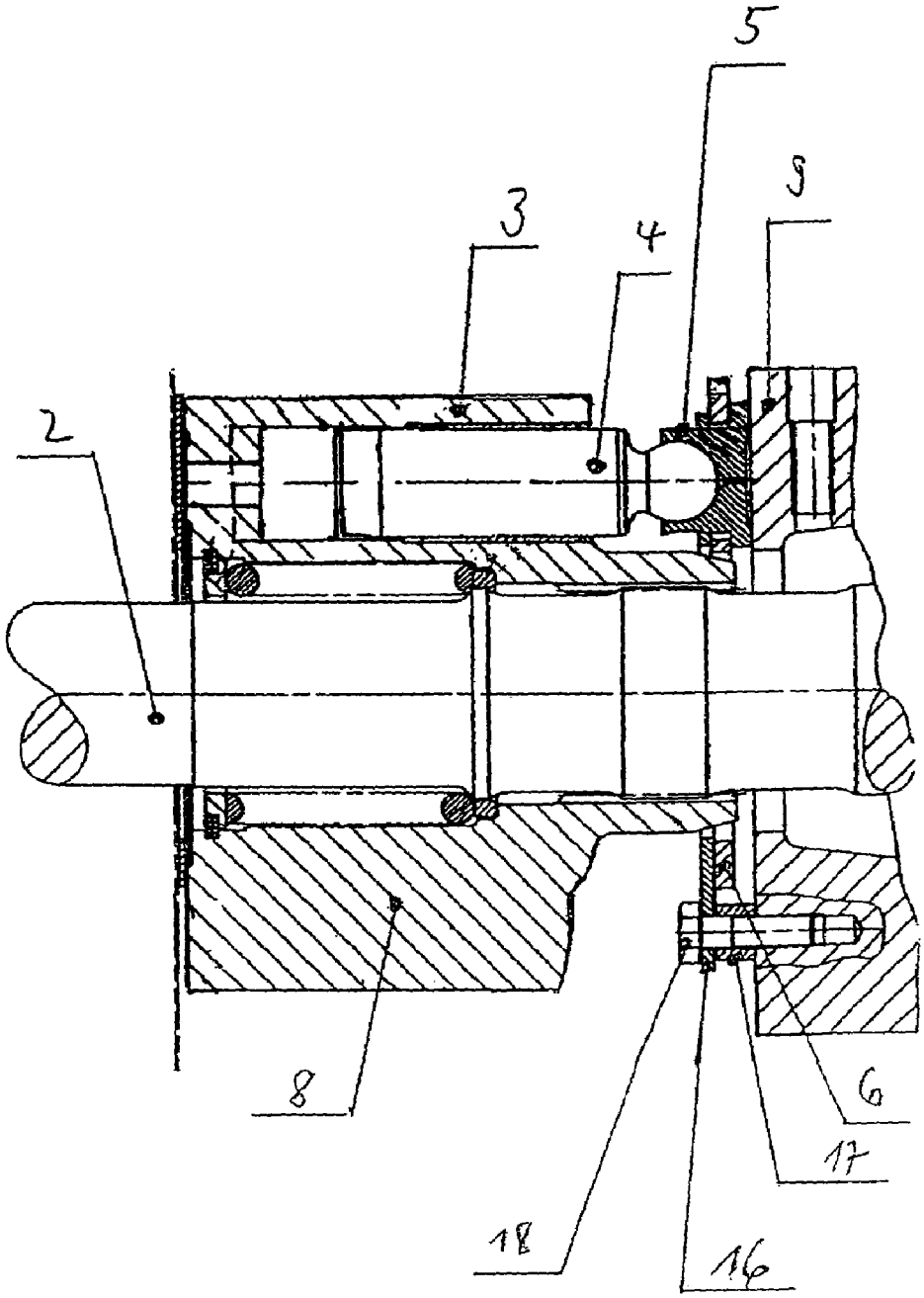
FIG. 3 shows a further embodiment of the hydrostatic adjustment unit according to FIG. 1 shows a section through the central part of a hydrostatic adjustment unit.

FIG. 3 shows a further embodiment of the hydrostatic adjustment unit 20 according to the invention. By means of the cylinder block 8, the cylinders 3 rotate about the shaft 2 with the displacer pistons guided in them. They are supported on the swash plate 9 by means of the slider blocks 5. The slider blocks 5 are held in abutment against the swash plate 9 by means of a slider block holder 6 which itself abuts in turn against a retaining element 16. The retaining element 16 is attached to the swash plate 9 by means of a screwed connection 18 and a spacer sleeve 17. The slider block holder 6 in turn forms the rotor of a rotational speed signal transmitter whose sensor (not illustrated in FIG. 3) is mounted opposite in a wall part of the housing.

According to the invention, a component of the swash plate unit which is present, specifically the slider block holder, additionally performs the function of the rotational speed signal transmitter, for which purpose otherwise independent components are required. As a result, various functions are combined in one component. This gives rise to a compact design and makes the assembly easier.

What is claimed:

1. Hydrostatic adjustment unit with a swash plate (9) and displacer pistons (4) which are arranged in a rotating cylinder block (8) with cylinders (3), and a rotational speed signal transmitter for determining the rotational speed of the cylinder block, wherein the displacer pistons (4) are each connected to a slider block (5) which bears against a support face on the swash plate (9) and is held in abutment by means of a slider block holder (6) which has a number of bores (11) for receiving the slider blocks (5) corresponding to the number of displacers, characterized in that the slider block holder at the same time forms the rotor of the rotational speed signal transfer wherein the slider block holder (6) in embodied as a gearwheel.

2. Hydrostatic adjustment unit according to claim 1, characterized in that a fixed sensor part (10), assigned to the slider block holder (6), of the rotational speed signal transmitter is arranged in the housing.

3. Hydrostatic adjustment unit according to claim 1, characterized in that the teeth of the slider block holder (6) have a rectangular profile (12) or a triangular profile or a trapezoidal profile.

4. Hydrostatic adjustment unit according to claim 1, characterized in that the edges of the teeth of the slider block holder are of asymmetrical design.

5. Hydrostatic adjustment unit according to claim 4, characterized in that an evaluation device is provided which determines the sense of rotation of the cylinder block from the signal generated by the asymetrical tooth edges.

6. Hydrostatic adjustment unit according to claim 1, characterized in that the slider block holder (6) abuts against a retaining element (16) which is screwed to the swash plate.

* * * * *